US009848262B2

(12) United States Patent
Iyer et al.

(10) Patent No.: US 9,848,262 B2
(45) Date of Patent: Dec. 19, 2017

(54) TECHNIQUES FOR TUNING THE DISTORTION RESPONSE OF A LOUDSPEAKER

(71) Applicant: Harman International Industries, Incorporated, Stamford, CT (US)

(72) Inventors: Ajay Iyer, Murray, UT (US); Jeffrey Hutchings, Lehi, UT (US); Richard Allen Kreifeldt, South Jordan, UT (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 15/078,896

(22) Filed: Mar. 23, 2016

(65) Prior Publication Data

US 2017/0280241 A1 Sep. 28, 2017

(51) Int. Cl.
*H04R 3/04* (2006.01)
*H04R 29/00* (2006.01)

(52) U.S. Cl.
CPC ..... *H04R 3/04* (2013.01); *H04R 29/001* (2013.01)

(58) Field of Classification Search
CPC .... H04R 29/001; H04R 3/04; H04R 2499/11; G10H 2/087; H03E 1/327
USPC ..... 381/59, 98, 94.1; 700/94
See application file for complete search history.

(56) References Cited

U.S. PATENT DOCUMENTS

2006/0274904 A1* 12/2006 Lashkari ..... H03F 1/3264 381/59
2013/0077801 A1* 3/2013 Tarnowski ..... H03G 11/00 381/94.1
2014/0341388 A1* 11/2014 Goldstein ..... H04R 1/1083 381/71.11
2015/0249889 A1 9/2015 Iyer et al.

FOREIGN PATENT DOCUMENTS

WO 00/56119 A1 9/2000
WO 2011/077408 A1 6/2011

OTHER PUBLICATIONS

Extended European Search Report for Application No. 17161093.4, dated Jul. 26, 2017, 9 pages.

* cited by examiner

*Primary Examiner* — Melur Ramakrishnaiah
(74) *Attorney, Agent, or Firm* — Artegis Law Group, LLP

(57) ABSTRACT

A corrector is configured to transform audio signals to compensate for unwanted distortion characteristics of a loudspeaker. A tuning filter is configured to transform audio signals to incorporate desired distortion characteristics associated with a target loudspeaker. By chaining together the tuning filter and the corrector, an audio signal can be modified so that the loudspeaker, when outputting the audio signal, has response characteristics of the target loudspeaker.

20 Claims, 13 Drawing Sheets

TECHNIQUES FOR TUNING THE DISTORTION RESPONSE OF A LOUDSPEAKER

BACKGROUND

Field of the Disclosed Embodiments

The disclosed embodiments relate generally to signal processing and, more specifically, to techniques for tuning the distortion response of a loudspeaker.

Description of the Related Art

A conventional loudspeaker is a physical device that generates acoustic signals based on electrical input signals. Loudspeakers may have a wide range of physical structures, although typically a loudspeaker includes one or more magnets, one or more voice coils, and one or more speaker cones. The magnet(s), voice coil(s), and speaker cone(s) associated with a given loudspeaker dictate the linear and non-linear response characteristics of the loudspeaker.

The non-linear response characteristics of a loudspeaker give rise to an acoustic effect known in the art as "distortion." Distortion may be undesirable in some cases, although in other cases, distortion may be perceived as adding desirable "texture" to the acoustic signal generated by the loudspeaker. For example, a guitar amplifier typically includes one or more distortion filters that amplify certain non-linear characteristics of a received guitar signal, thereby producing a distorted guitar signal that some listeners find acoustically pleasing.

One drawback associated with conventional loudspeakers is that the distortion associated with a given loudspeaker is dependent on the physical structure of that loudspeaker. Thus, the characteristics of the distortion usually cannot be changed without altering the physical structure the loudspeaker. Consequently, any distortion added by a loudspeaker typically comprises a portion of the acoustic output of the loudspeaker.

As the foregoing illustrates, more effective techniques for adjusting the distortion response of a loudspeaker would be useful.

SUMMARY

One or more embodiments set forth include a computer-implemented method for generating a desired response for a loudspeaker, including tuning an audio signal to augment one or more desired distortion characteristics associated with a first output device to produce a tuned audio signal, correcting the tuned audio signal to attenuate one or more undesired distortion characteristics associated with a second output device to produce a corrected audio signal, outputting a final signal, via the second output device, that is based on the corrected audio signal, where the final signal includes the one or more desired distortion characteristics associated with the first output device.

At least one advantage of the disclosed embodiments is that unwanted distortion characteristics associated with a loudspeaker can be mitigated, while desired distortion characteristics associated with another loudspeaker can be incorporated into an audio signal.

BRIEF DESCRIPTION OF THE SEVERAL VIEWS OF THE DRAWINGS

So that the manner in which the recited features of the one more embodiments set forth above can be understood in detail, a more particular description of the one or more embodiments, briefly summarized above, may be had by reference to certain specific embodiments, some of which are illustrated in the appended drawings. It is to be noted, however, that the appended drawings illustrate only typical embodiments and are therefore not to be considered limiting of its scope in any manner, for the scope of the disclosed embodiments subsumes other embodiments as well.

DETAILED DESCRIPTION

In the following description, numerous specific details are set forth to provide a more thorough understanding of certain specific embodiments. However, it will be apparent to one of skill in the art that other embodiments may be practiced without one or more of these specific details or with additional specific details.

System Overview

Figure 1:
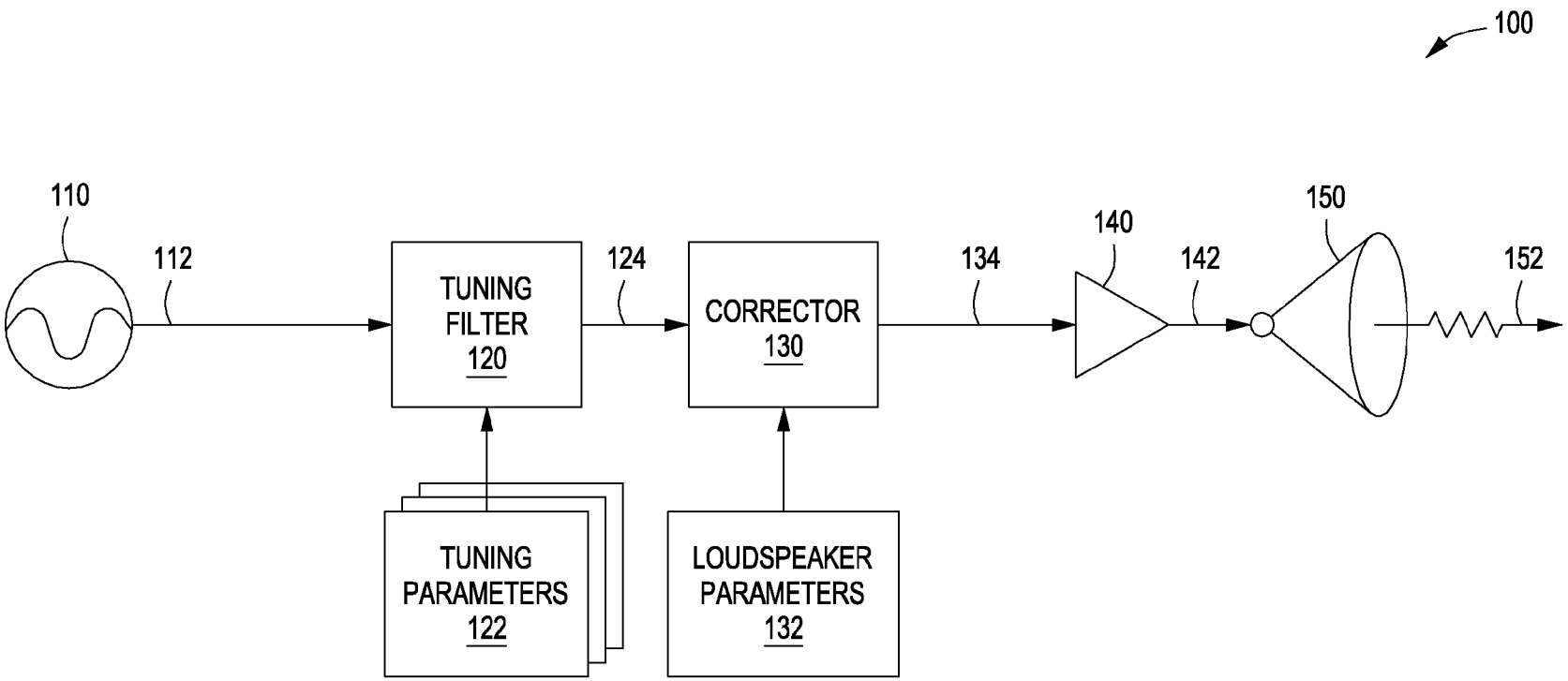
FIG. 1 illustrates a system configured to implement one or more aspects of the various embodiments.

FIG. 1 illustrates a system configured to implement one or more aspects of the various embodiments. As shown, signal chain 100 includes a signal source 110, a tuning filter 120, a corrector 130, an amplifier 140, and a loudspeaker 150 coupled together in a cascading manner. Signal chain 100, and the elements included therein, may be implemented via any technically feasible combination of hardware and/or software elements, as also described in greater detail below in conjunction with FIG. 2.

During operation of signal chain 100, signal source 110 generates an audio signal 112 and then transmits that audio signal to tuning filter 120. Tuning filter 120 processes audio signal 112, based on tuning parameters 122, and generates tuned signal 124. Tuning filter 120 transmits tuned signal 124 to corrector 130. Corrector 130 processes tuned signal 124, based on loudspeaker parameters 132, to generate pre-corrected signal 134. Corrector 130 transmits pre-corrected signal 134 to amplifier 140. Amplifier 140 amplifies pre-corrected signal 134 to generate amplified signal 142. Amplifier 140 transmits amplified signal 142 to loudspeaker 150. Loudspeaker 150 generates acoustic signal 152 based on amplified signal 142 and then outputs acoustic signal 152.

Signal source 110 may be any technically feasible source of electrical audio signals, including, for example and without limitation, a microphone, an electric guitar pickup, a digital signal generator, and so forth. Audio signal 112 is an electrical signal that may represent an acoustic signal transduced by signal source 110 or a purely virtual signal generated by signal source 110.

Tuning filter 120 is an analog or digital filter configured to perform a signal processing operation with audio signal 112 to incorporate desired linear and/or non-linear characteristics into that signal, including desired distortion characteristics. Those distortion characteristics are defined by tuning parameters 122. Tuning parameters 122 define different sets of distortion characteristics that may correspond to different loudspeakers which loudspeaker 150 can be configured to emulate via the various stages of signal chain 100.

Tuning filter 120 and tuning parameters 122 may be generated via a wide variety of different types of processes, including, for example and without limitation, physical system modeling, Hammerstein models, and Volterra kernels, among others. An exemplary approach for generating tuning filter 120 and tuning parameters 122 is described in greater detail below in conjunction with FIGS. 8B-9. As mentioned, tuning filter 120 processes audio signal 112, based on tuning parameters 122, to generate tuned signal 124. Tuned signal 124 represents audio signal 112 modified to include the aforementioned desired distortion characteristics.

Corrector 130 is an analog or digital filter configured to perform a signal processing operation with tuned signal 124 to compensate for certain linear and/or non-linear characteristics, including unwanted distortion characteristics that may be subsequently induced by loudspeaker 150. Those distortion characteristics are defined by loudspeaker parameters 132. Loudspeaker parameters 132 represent a model of loudspeaker 150, and may be used by corrector 130 as an inverse transfer function of loudspeaker 150. Thus, corrector 130 "pre-corrects" tuned signal 124 to pre-emptively mitigate unwanted distortive effects of loudspeaker 150.

Corrector 130 and loudspeaker parameters 132 may be generated via a wide variety of different types of processes, including, for example and without limitation, physical system modeling, Hammerstein models, and Volterra kernels, among others. An exemplary approach for generating corrector 130 and loudspeaker parameters 132 is described in greater detail below in conjunction with FIGS. 8A-9. As mentioned, corrector 130 processes tuned signal 124, based on loudspeaker parameters 132, to generate pre-corrected signal 134.

Figure 2:
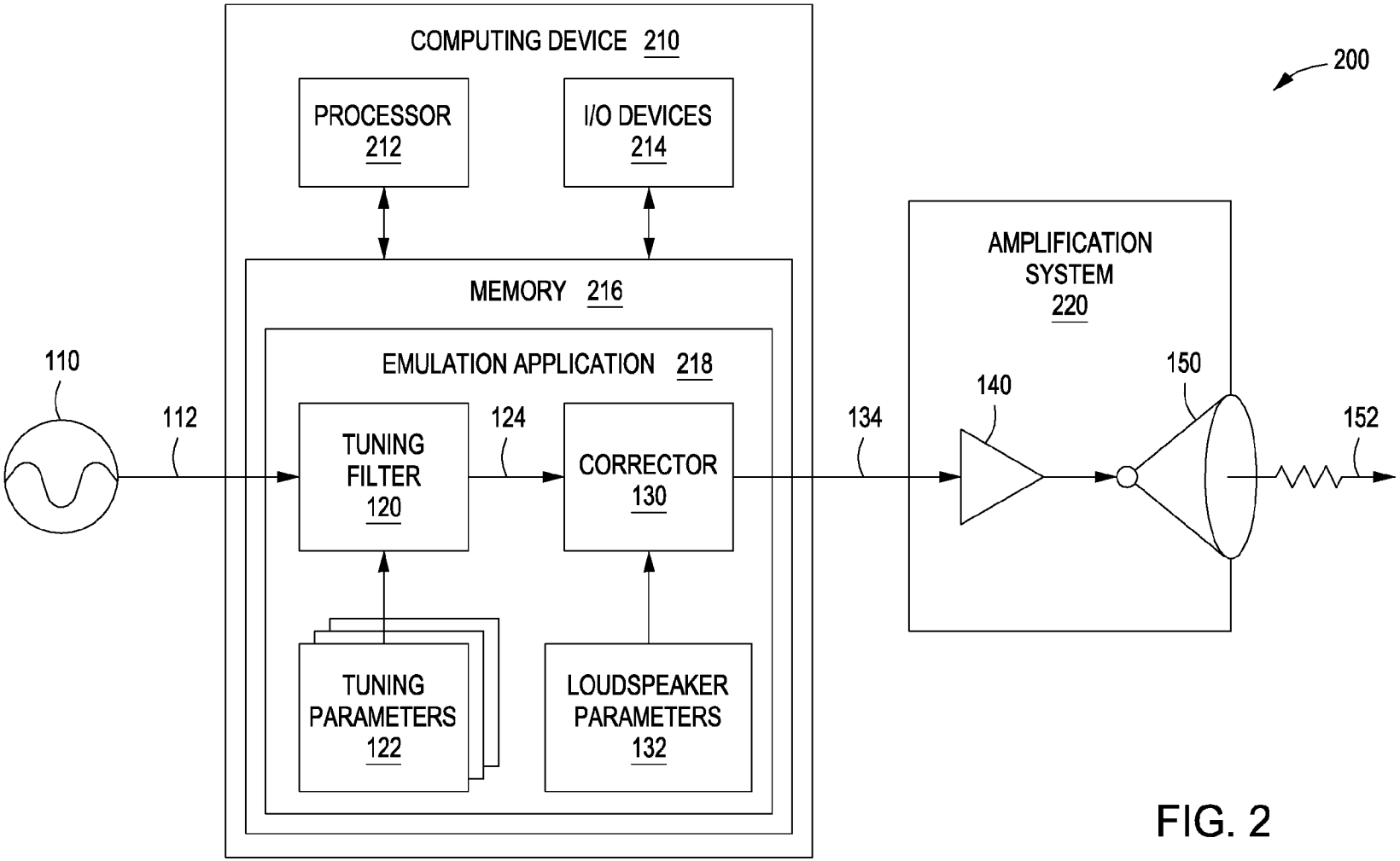
FIG. 2 illustrates an exemplary implementation of the system of FIG. 1, according to various embodiments.

Amplifier 140 is a signal processing element configured to amplify the magnitude of pre-corrected signal 134. In doing so, amplifier 140 generates amplified signal 142. Loudspeaker 150 receives amplified signal 142, and then generates acoustic signal 152. Because tuning filter 120 incorporates desired distortion characteristics into audio signal 112, as described, and corrector 130 compensates for unwanted distortion characteristics within the loudspeaker 150, acoustic signal 152 can be specifically designed to have precise characteristics. Thus, signal chain 100, as a whole, converts audio signal 112 into acoustic signal 152 with specifically designed linear and/or non-linear characteristics. Signal chain 100 may be implemented in many different ways, as mentioned. FIG. 2 illustrates one exemplary implementation.

FIG. 2 illustrates an exemplary implementation of the system of FIG. 1, according to various embodiments. As shown, an implementation 200 of signal chain 100 includes signal source 110 coupled to computing device 210 that, in turn, is coupled to an amplification system 220.

Computing device 210 includes a processor 212, input/output (I/O) devices 214, and a memory 216. Memory 216 includes an emulation application 218. Emulation application 218 includes tuning filter 120, tuning parameters 122, corrector 130, and loudspeaker parameters 132.

Processor 212 may be any technically feasible hardware for processing data and executing applications, including, for example and without limitation, a central processing unit (CPU), an application specific integrated circuit (ASIC), a field-programmable gate array (FPGA), among others. I/O devices 214 may include devices for receiving input, such as a keyboard, mouse, or microphone, for example and without limitation, devices for providing output, such as a display screen or a speaker, for example and without limitation, and devices for receiving input and providing output, such as a touchscreen, for example and without limitation.

Memory 216 may be any technically feasible medium configured to store data, including, for example and without limitation, a hard disk, a random access memory (RAM), a read-only memory (ROM), and so forth. Emulation application 218 includes program code that, when executed by processor 212, performs the various operations of tuning filter 120 and corrector 130 previously described in conjunction with FIG. 1.

Amplification system 220 includes amplifier 140 and loudspeaker 150. Amplification system 220 could be, for example, and without limitation, a musical instrument amplifier or a public address (PA) system, among other possibilities. In one embodiment, amplification system 220 is a simulated device.

Again, signal chain 100 may be implemented in any technically feasible manner. Implementation 200 is provided here for illustrative purposes only, and is not meant to be limiting. The operation of signal chain 100 is described in greater detail below in conjunction with FIGS. 3A-6D.

Comparison of Response Characteristics of Signal Chain Elements

FIGS. 3A-3D illustrate various graphs that compare an original response of the loudspeaker of FIG. 1 to a corrected response, according to various embodiments.

Figure 3A:
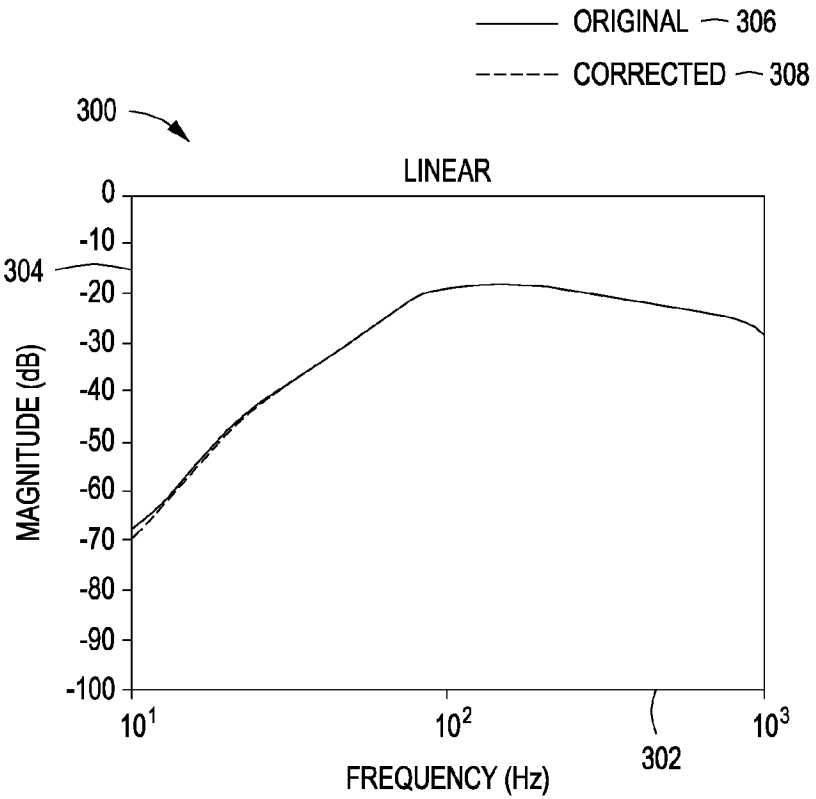
FIGS. 3A-3D illustrate various graphs that compare an original response of the loudspeaker of FIG. 1 to a corrected response, according to various embodiments.

As shown in FIG. 3A, a graph 300 includes X-axis 302 and Y-axis 304, along which original response 306 of loudspeaker 150 and corrected response 308 of the cascade of corrector 130 and loudspeaker 150 are displayed. In FIG. 3A, original response 306 and corrected response 308 are linear responses.

Figure 3B:
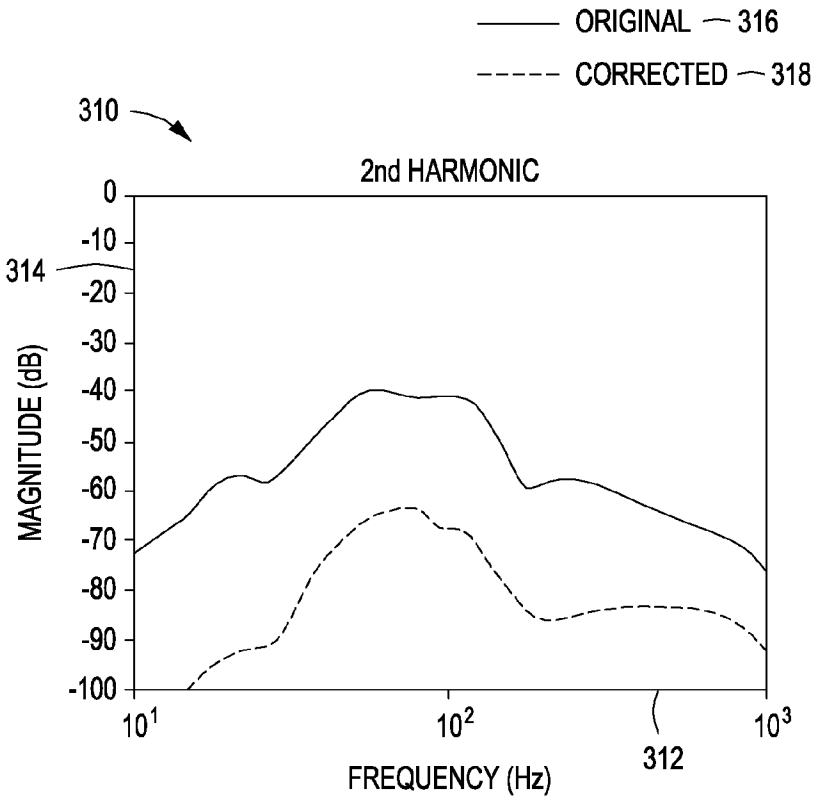

As shown in FIG. 3B, a graph 310 includes X-axis 312 and Y-axis 314, along which original response 316 of loudspeaker 150 and corrected response 318 of the cascade of corrector 130 and loudspeaker 150 are displayed. In FIG. 3B, original response 316 and corrected response 318 are $2^{nd}$ harmonic distortion responses.

Figure 3D:
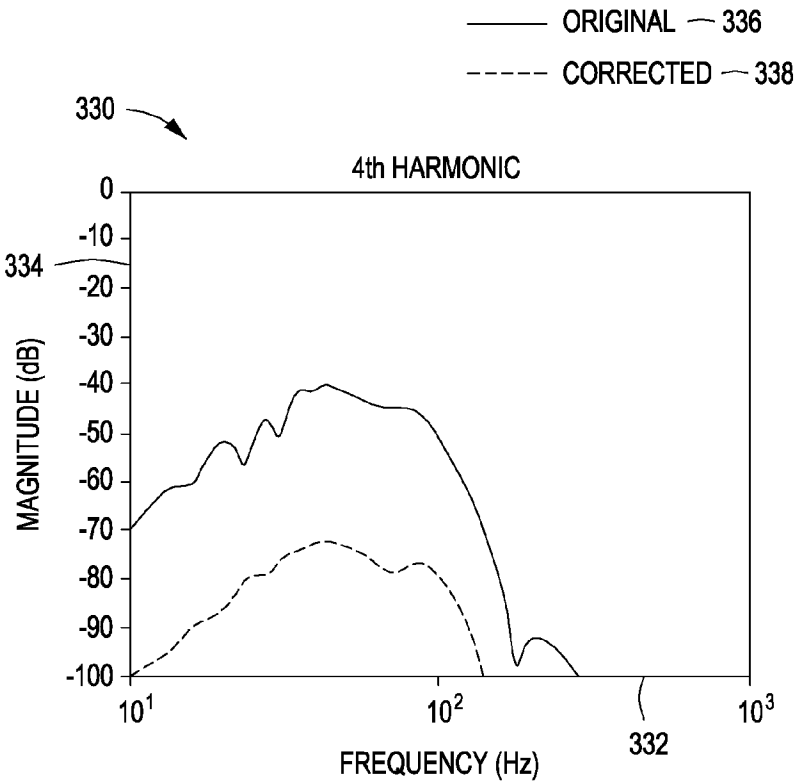
Figure 3C:
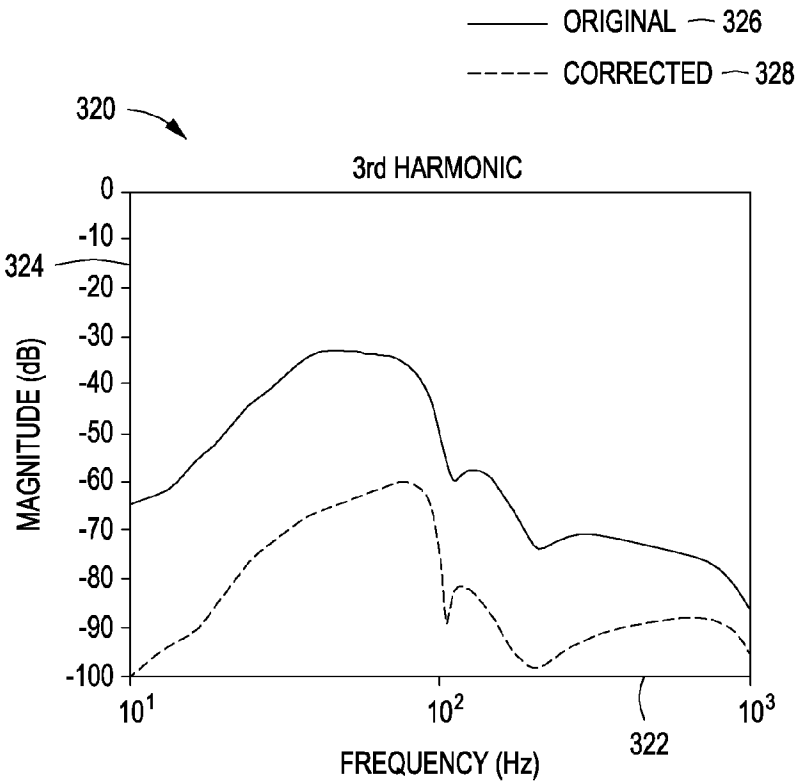

As shown in FIG. 3C, a graph 320 includes X-axis 322 and Y-axis 324, along which original response 326 of loudspeaker 150 and corrected response 328 of the cascade of corrector 130 and loudspeaker 150 are displayed. In FIG. 3C, original response 326 and corrected response 328 are $3^{rd}$ harmonic distortion responses.

As shown in FIG. 3D, a graph 330 includes X-axis 332 and Y-axis 334, along which original response 336 of loudspeaker 150 and corrected response 338 of the cascade of corrector 130 and loudspeaker 150 are displayed. In FIG. 3D, original response 336 and corrected response 338 are $4^{th}$ harmonic distortion responses.

Referring generally to FIGS. 3A-3D, the various graphs shown illustrate that corrector 130 causes the loudspeaker 150 to generate a corrected response, in various linear and non-linear regimes, having a modified magnitude at many frequencies compared to the original response of loudspeaker 150. Thus, corrector 130 may reduce or eliminate specific response characteristics associated with certain frequencies. Those specific response characteristics may represent unwanted distortion potentially induced by loudspeaker 150 when generating acoustic signals. Corrector 130 pre-corrects received signals to compensate for such unwanted distortion prior to the generation of that distortion by loudspeaker 150. The specific corrected responses shown are generally derived from loudspeaker parameters 132.

Figure 4A:
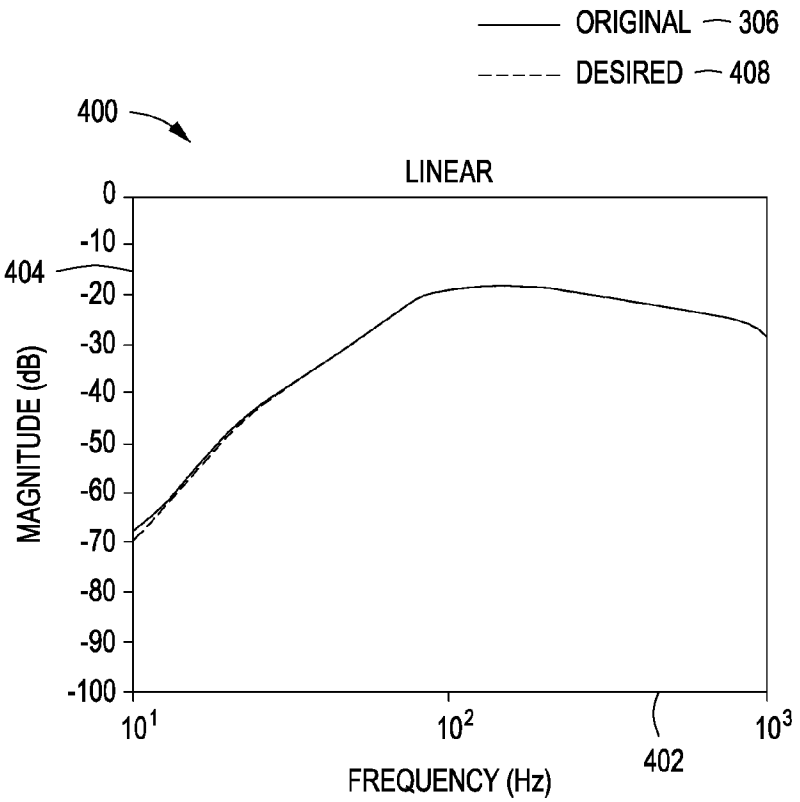
FIGS. 4A-4D illustrate various graphs that compare an original response of the loudspeaker of FIG. 1 to a desired response, according to various embodiments.

FIGS. 4A-4D illustrate various graphs that compare an original response of the loudspeaker of FIG. 1 to a desired response, according to various embodiments;

As shown in FIG. 4A, a graph 400 includes X-axis 402 and Y-axis 404, along which original response 306 of loudspeaker 150 and desired response 408 of tuning filter 120 are displayed. In FIG. 4A, original response 306 and desired response 408 are linear responses.

Figure 4B:
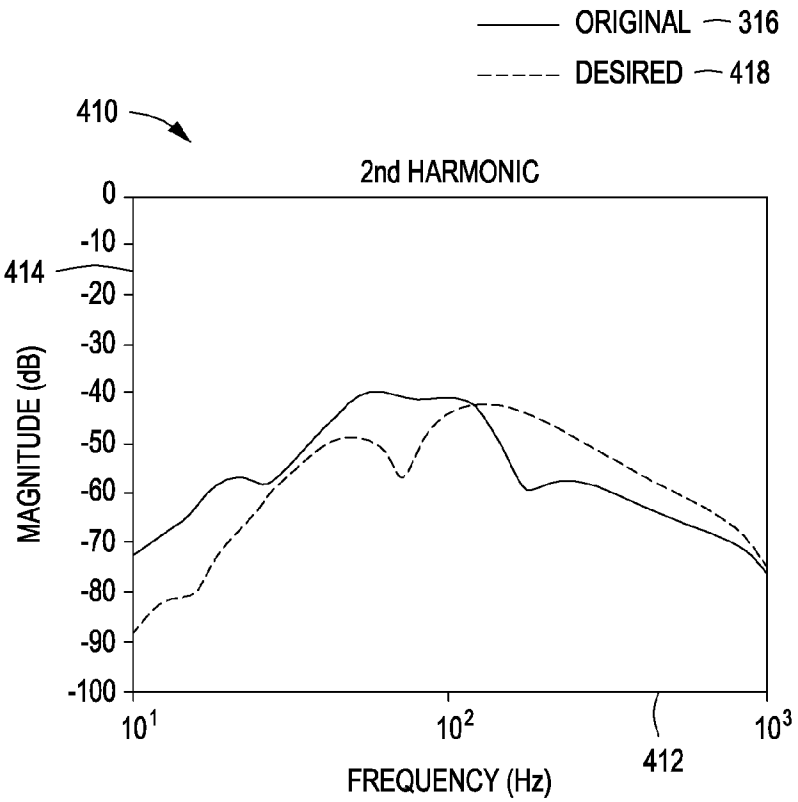

As shown in FIG. 4B, a graph 410 includes X-axis 412 and Y-axis 414, along which original response 316 of loudspeaker 150 and desired response 418 of tuning filter 120 are displayed. In FIG. 4B, original response 316 and desired response 418 are $2^{nd}$ harmonic distortion responses.

Figure 4D:
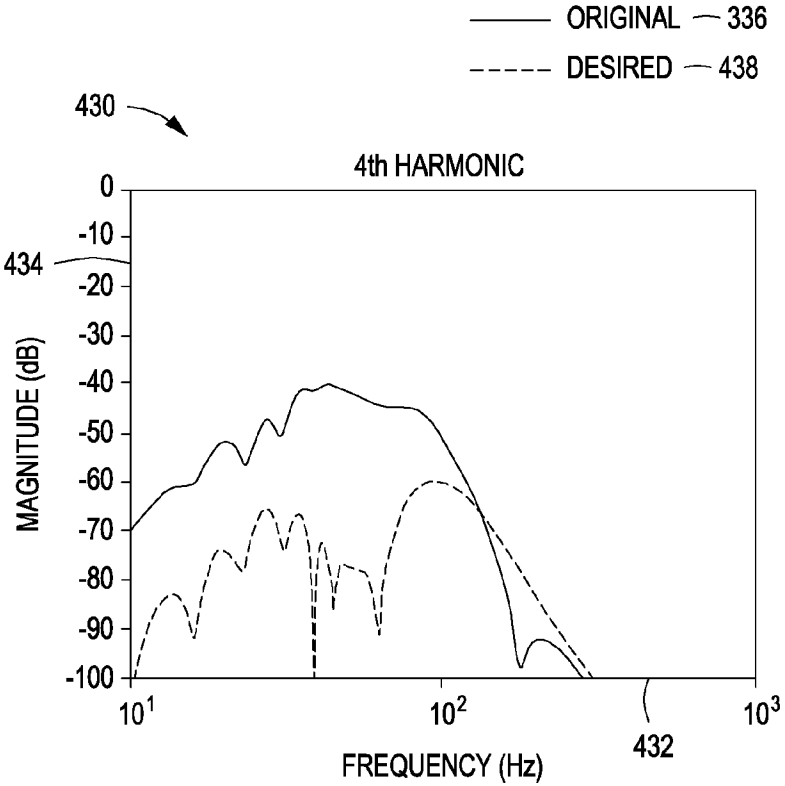
Figure 4C:
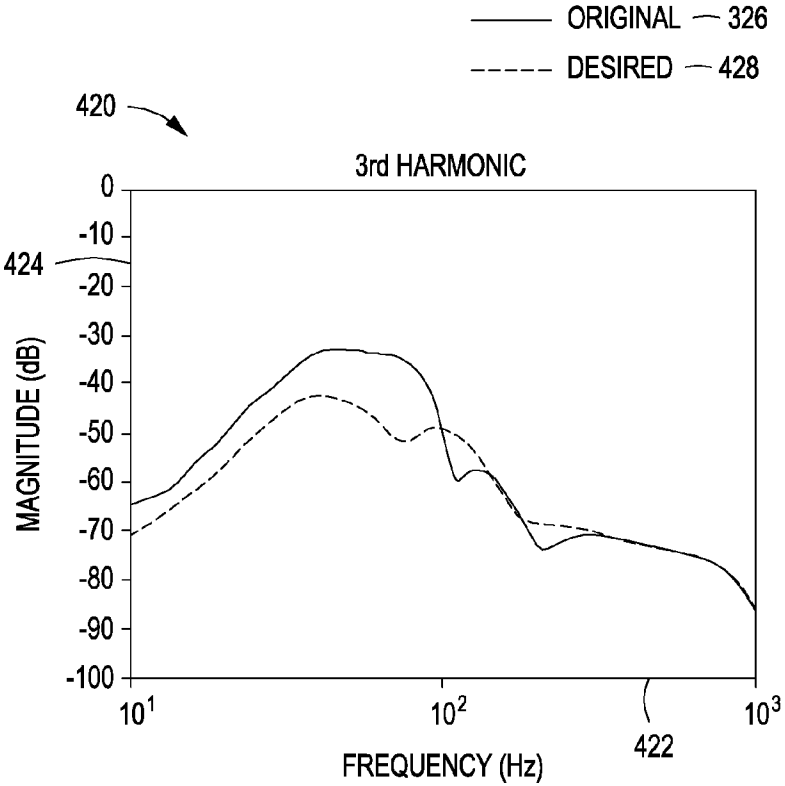

As shown in FIG. 4C, a graph 420 includes X-axis 422 and Y-axis 424, along which original response 326 of loudspeaker 150 and desired response 428 of tuning filter 120 are displayed. In FIG. 4C, original response 326 and desired response 428 are $3^{rd}$ harmonic distortion responses.

As shown in FIG. 4D, a graph 430 includes X-axis 432 and Y-axis 434, along which original response 336 of loudspeaker 150 and desired response 438 of tuning filter 120 are displayed. In FIG. 4D, original response 336 and desired response 438 are $4^{th}$ harmonic distortion responses.

Referring generally to FIGS. 4A-4D, the various graphs shown illustrate that tuning filter 120 generates a desired response, in various linear and non-linear regimes, having a modified magnitude at many frequencies compared to the original response of loudspeaker 150. Thus, tuning filter 120 may introduce specific response characteristics associated with certain frequencies. Those specific response characteristics may represent desired distortion associated with a loudspeaker having a different physical construction compared to loudspeaker 150. Tuning filter 120 tunes received signals to add desired distortion prior to loudspeaker 150 outputting those signals. The specific desired responses shown are generally derived from tuning parameters 122.

FIGS. 5A-5D illustrate various graphs that compare the corrected response of FIGS. 3A-3D to the desired response of FIGS. 4A-4D, according to various embodiments.

Figure 5B:
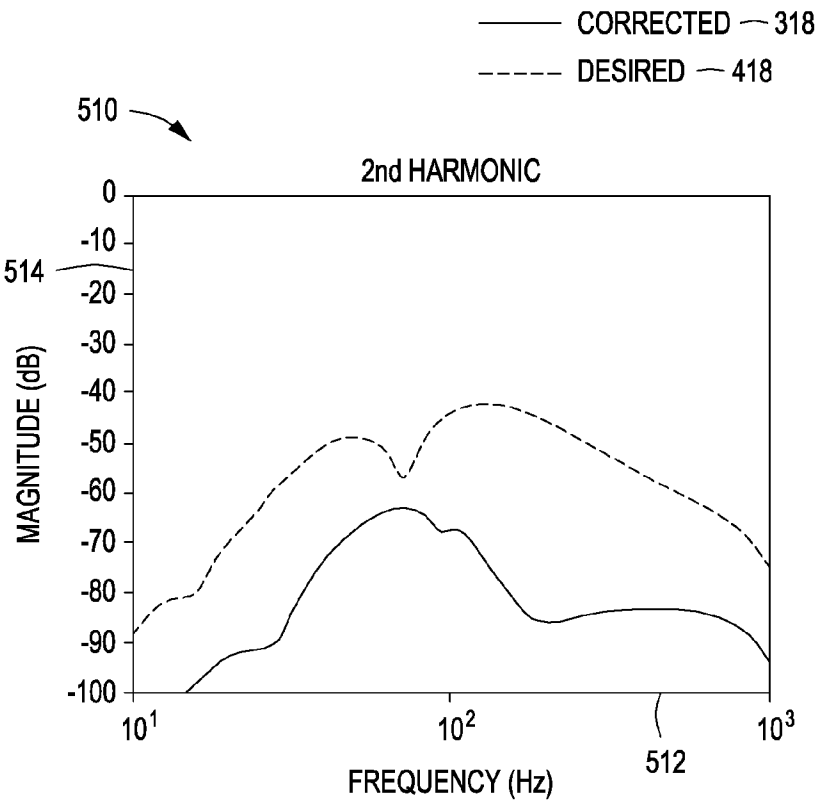
FIGS. 5A-5D illustrate various graphs that compare the corrected response of FIGS. 3A-3D to the desired response of FIGS. 4A-4D, according to various embodiments.
Figure 5A:
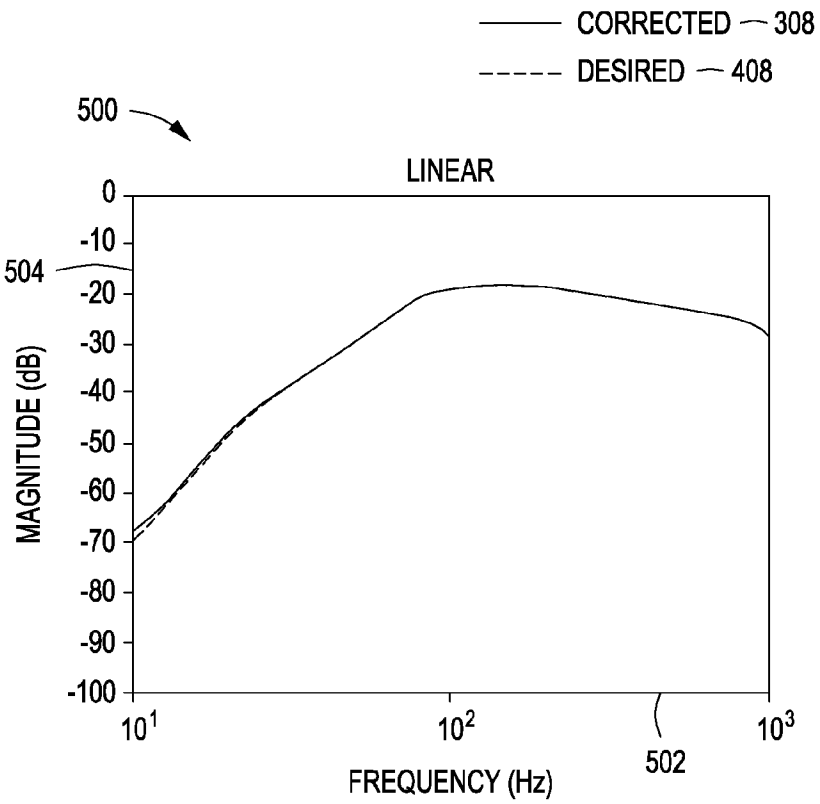

As shown in FIG. 5A, a graph 500 includes X-axis 502 and Y-axis 504, along which corrected response 308 of the cascade of corrector 130 and loudspeaker 150 and desired response 408 of tuning filter 120 are displayed. In FIG. 5A, corrected response 308 and desired response 408 are linear responses.

As shown in FIG. 5B, a graph 510 includes X-axis 512 and Y-axis 514, along which corrected response 318 of the cascade of corrector 130 and loudspeaker 150 and desired response 418 of tuning filter 120 are displayed. In FIG. 5B, corrected response 318 and desired response 418 are $2^{nd}$ harmonic distortion responses.

Figure 5D:
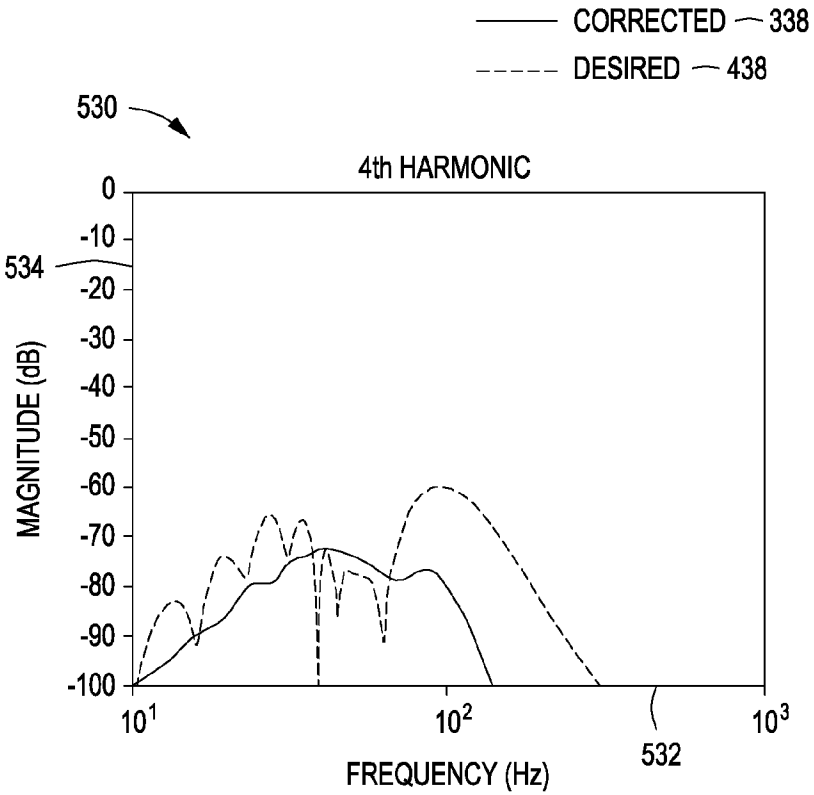
Figure 5C:
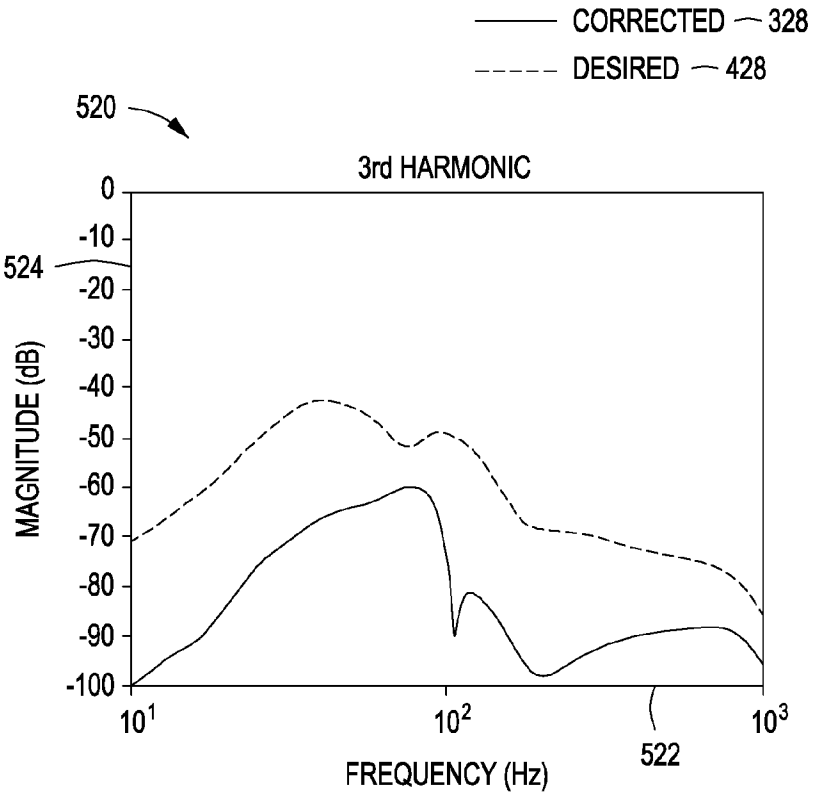

As shown in FIG. 5C, a graph 520 includes X-axis 522 and Y-axis 524, along which corrected response 328 of the cascade of corrector 130 and loudspeaker 150 and desired response 428 of tuning filter 120 are displayed. In FIG. 5C, corrected response 328 and desired response 428 are $3^{rd}$ harmonic distortion responses.

As shown in FIG. 5D, a graph 530 includes X-axis 532 and Y-axis 534, along which corrected response 338 of the cascade of corrector 130 and loudspeaker 150 and desired response 438 of tuning filter 120 are displayed. In FIG. 5D, corrected response 338 and desired response 438 are $4^{th}$ harmonic distortion responses.

Referring generally to FIGS. 5A-5D, the various graphs shown compare the desired response associated with tuning filter 120 to the corrected response associated with the cascade of the corrector 130 and loudspeaker 150 in various linear and non-linear regimes. When audio signals are processed via both tuning filter 120, corrector 130 and the loudspeaker 150, thereby applying the various responses shown in these figures, acoustic signals can be generated that lack specific unwanted distortion characteristics and include target distortion characteristics.

FIGS. 6A-6D illustrate various graphs that compare a final response of the loudspeaker of FIG. 1 to the desired response of FIGS. 4A-4D, according to various embodiments.

Figure 6B:
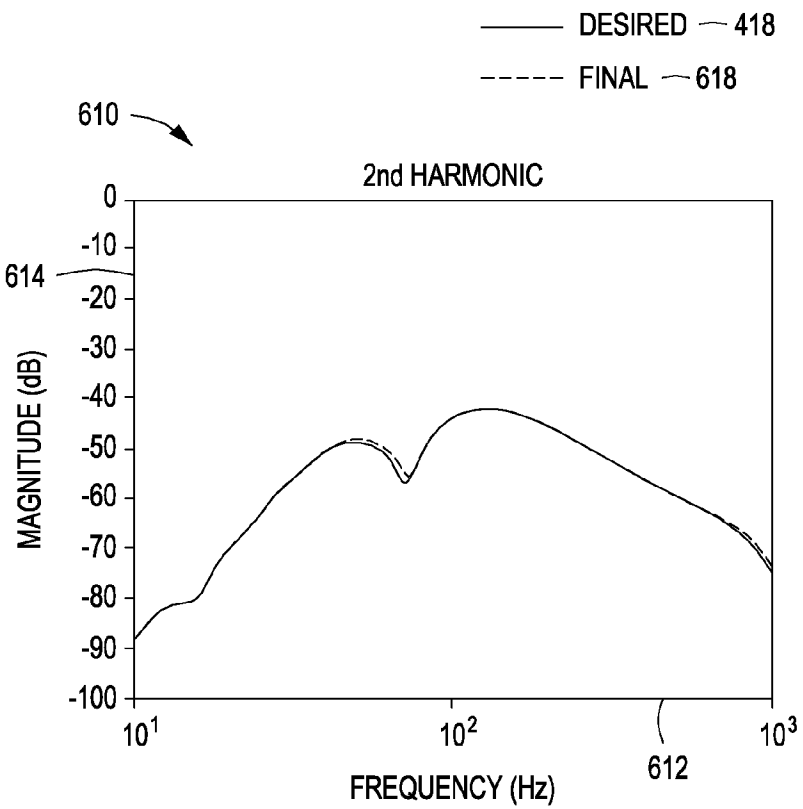
FIGS. 6A-6D illustrate various graphs that compare a final response of the loudspeaker of FIG. 1 to the desired response of FIGS. 4A-4D, according to various embodiments.
Figure 6A:
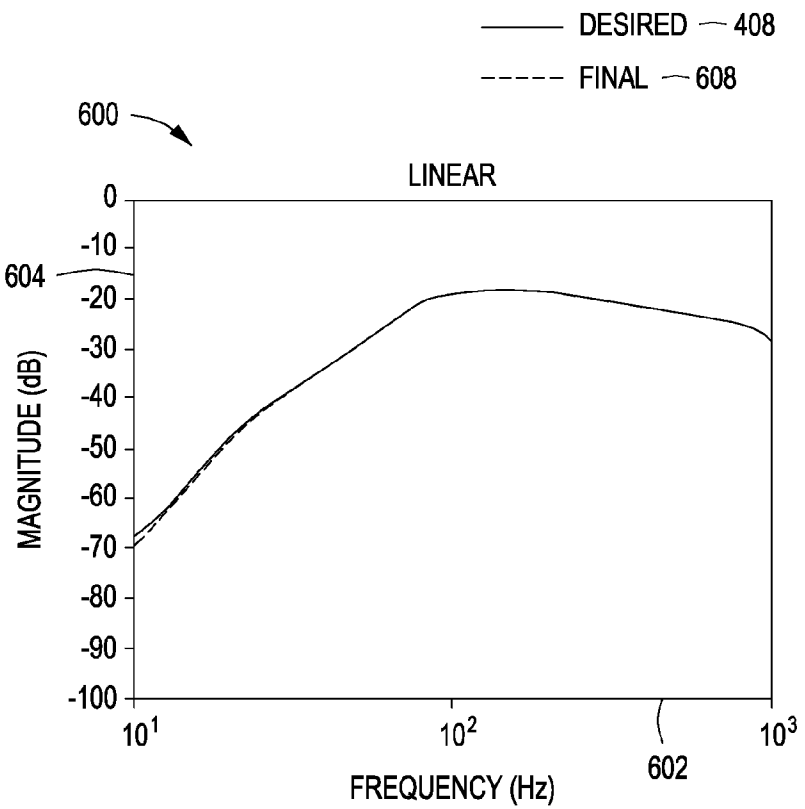

As shown in FIG. 6A, a graph 600 includes X-axis 602 and Y-axis 604, along which desired response 408 of tuning filter 120 and final response 608 of loudspeaker 150 are displayed. In FIG. 6A, desired response 408 and final response 608 are linear responses.

As shown in FIG. 6B, a graph 610 includes X-axis 612 and Y-axis 614, along which desired response 418 of tuning filter 120 and final response 618 of loudspeaker 150 are displayed. In FIG. 6B, desired response 418 and final response 618 are $2^{nd}$ harmonic distortion responses.

Figure 6D:
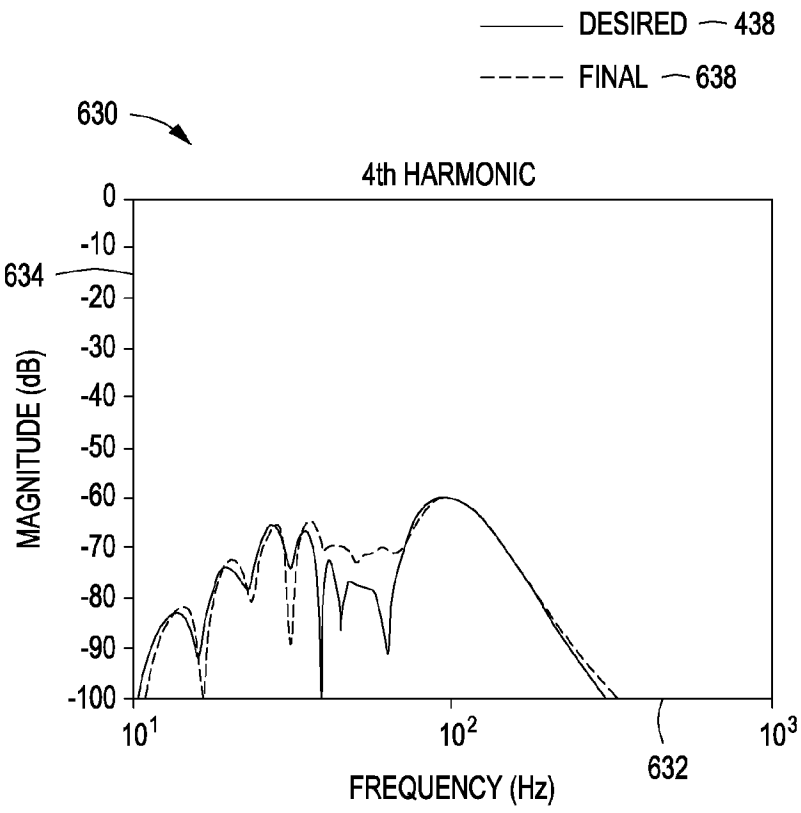
Figure 6C:
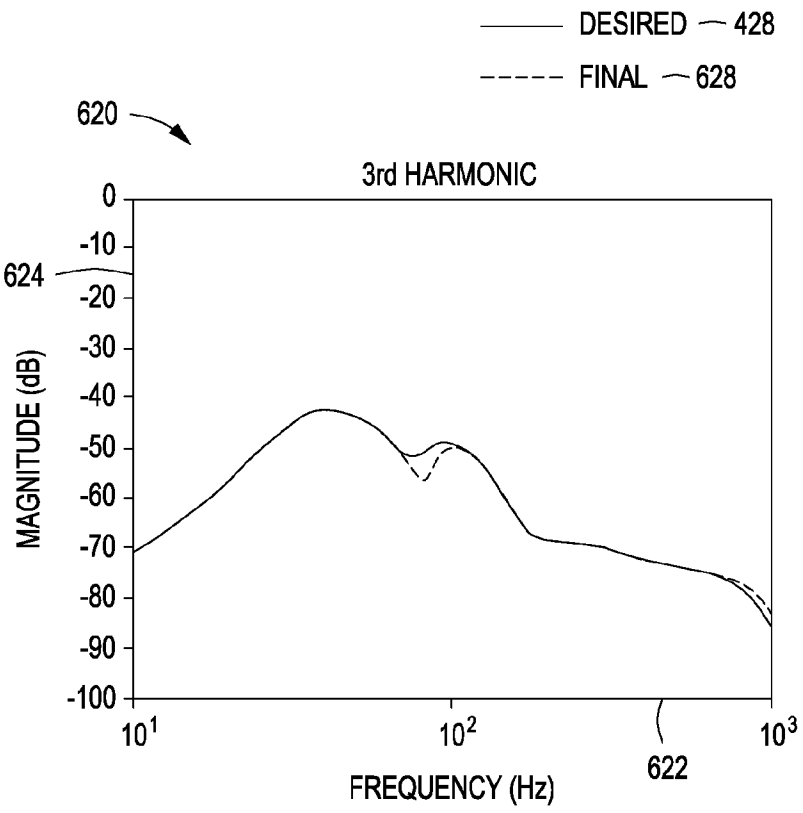

As shown in FIG. 6C, a graph 620 includes X-axis 622 and Y-axis 624, along which desired response 428 of tuning filter 120 and final response 628 of loudspeaker 150 are displayed. In FIG. 6C, desired response 428 and final response 628 are $3^{rd}$ harmonic distortion responses.

As shown in FIG. 6D, a graph 630 includes X-axis 632 and Y-axis 634, along which desired response 438 of tuning filter 120 and final response 638 of loudspeaker 150 are displayed. In FIG. 6D, desired response 438 and final response 638 are $4^{th}$ harmonic distortion responses.

Referring generally to FIGS. 6A-6D, the various graphs shown compare the desired response associated with tuning filter 120 to the final response of loudspeaker 150 in various linear and non-linear regimes. Ideally, the two responses in any particular regime are identical. However, due to potential limitations in modeling loudspeaker 150, the actual response of loudspeaker 150 may differ slightly from the desired response of that loudspeaker. In particular, corrector 130 may not perform an ideal inverse of loudspeaker 150, and therefore may not be able to eliminate all distortion characteristics introduced by loudspeaker 150. Nonetheless, corrector 130 may approximate an inverse of loudspeaker 150 with arbitrary accuracy that may approach an ideal inverse.

Persons skilled in the art will recognize that the different graphs shown in FIGS. 3A-6D are provided for exemplary purposes in order to illustrate possible responses of tuning filter 120, corrector 130, and loudspeaker 150. The actual response curves of these elements may vary based on tuning parameters 122, loudspeaker parameters 132, and the physical nature of loudspeaker 150.

Figure 7:
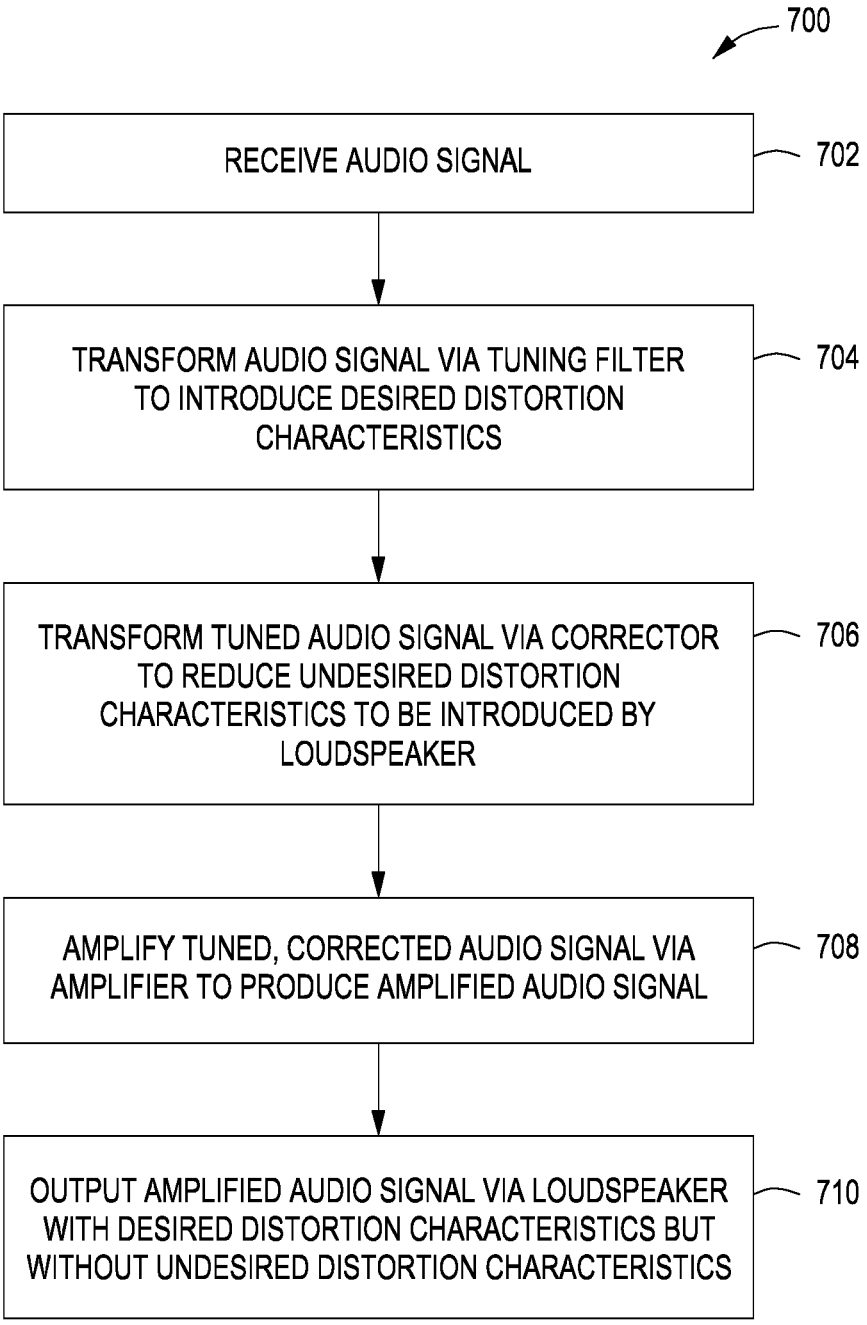
FIG. 7 is a flow diagram of method steps for modifying a distortion response of a loudspeaker, according to various embodiments.

FIG. 7 is a flow diagram of method steps for modifying a distortion response of a loudspeaker, according to various embodiments. Although the method steps are described in conjunction with the systems of FIGS. 1-6D, persons skilled in the art will understand that any system configured to perform the method steps, in any order, is within the scope of the disclosed embodiments.

As shown, a method 700 begins at step 702, where tuning filter 120 receives audio signal 112 from audio source 110. Signal source 110 may be any technically feasible source of electrical audio signals, including, for example and without limitation, a microphone, an electric guitar pickup, a digital signal generator, and so forth. Audio signal 112 is an electrical signal that may represent an acoustic signal transduced by signal source 110 or a purely virtual signal generated by signal source 110.

At step 704, tuning filter transforms audio signal 112 to augment desired distortion characteristics. In doing so, tuning filter 120 generates tuned signal 124. Tuning filter 120 is an analog or digital filter configured to perform a signal processing operation with audio signal 112 to incorporate desired linear and/or non-linear characteristics into that signal, including desired distortion characteristics. Those distortion characteristics are defined by tuning parameters 122. Tuning parameters 122 define different sets of distortion characteristics that may correspond to different loudspeakers which loudspeaker 150 can be configured to emulate via the various stages of signal chain 100.

At step 706, corrector transforms tuned signal 124 to attenuate unwanted distortion characteristics potentially introduced by loudspeaker 150. In doing so, corrector 130 generates pre-corrected signal 134. Corrector 130 is an analog or digital filter configured to perform a signal processing operation with tuned signal 124 to compensate for certain linear and/or non-linear characteristics, including unwanted distortion characteristics that may be subsequently induced by loudspeaker 150. Those distortion characteristics are defined by loudspeaker parameters 132. Loudspeaker parameters 132 represent a model of loudspeaker 150, and may be used by corrector 130 as an inverse transfer function of loudspeaker 150. Thus, corrector 130 "pre-corrects" tuned signal 124 to pre-emptively mitigate unwanted distortive effects of loudspeaker 150.

At step 708, amplifier 140 amplifies pre-corrected signal 134 to produce amplified signal 142. Amplified signal 142 represents an amplified version of pre-corrected signal 142 having larger amplitude. At step 710, loudspeaker 150 outputs acoustic signal 152 with desired distortion characteristics introduced by tuning filter 120 but without unwanted distortion characteristics nominally associated with loudspeaker 150. Because tuning filter 120 incorporates desired distortion characteristics into audio signal 112, as described, and corrector 130 compensates for unwanted distortion characteristics within tuned signal 124, acoustic signal 152 can be specifically designed to have precise characteristics. Thus, signal chain 100, as a whole, converts audio signal 112 into acoustic signal 152 with specifically designed linear and/or non-linear characteristics.

As mentioned above, tuning filter 120 and/or tuning parameters 122 and corrector 130 and/or loudspeaker parameters 132 may be generated via a number of different technically feasible approaches. Exemplary approaches for generating these elements are described in greater detail below in conjunction with FIGS. 8A and 8B.

Tuning Filter and Corrector Configuration

Figure 8A:
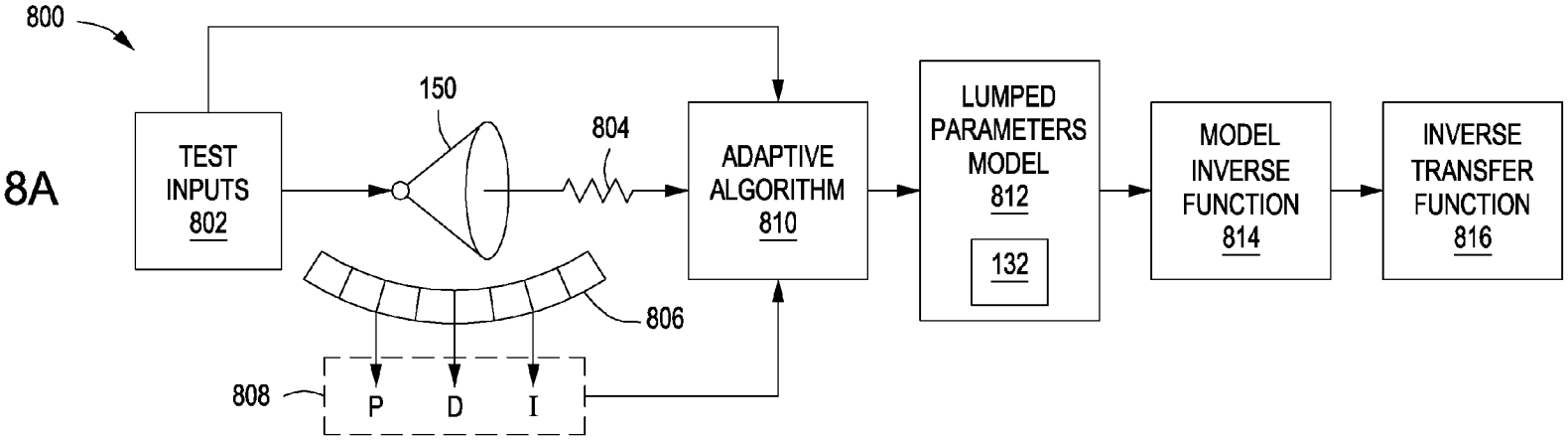
FIGS. 8A-8B illustrate exemplary subsystems that model the tuning filter and the corrector of FIG. 1, according to various embodiments.
Figure 8B:
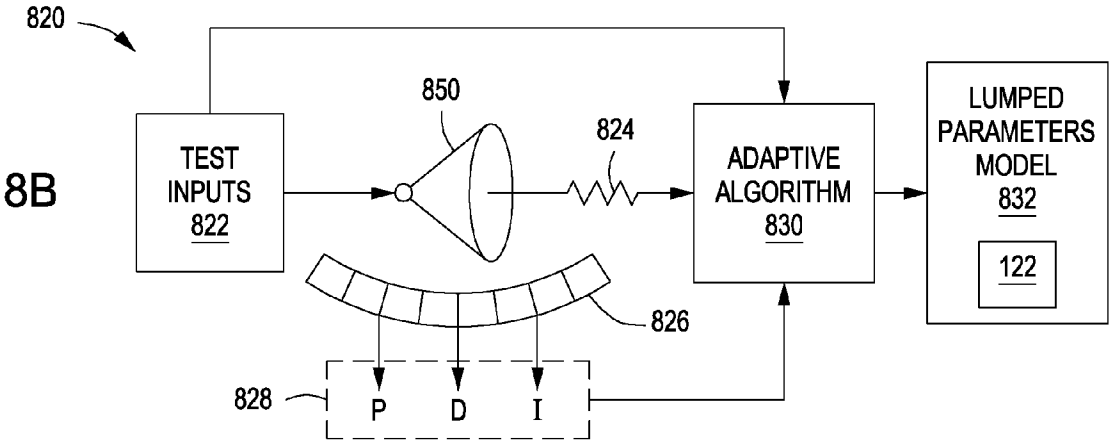

FIGS. 8A-8B illustrate exemplary subsystems that model the tuning filter and the corrector of FIG. 1, according to various embodiments. As discussed above in conjunction with FIG. 1, many technically feasible approaches may be applied to generate tuning filter 120 and corrector 130. FIGS. 8A-8B illustrate exemplary, non-limiting approaches.

As shown in FIG. 8A, a signal chain 800 includes loudspeaker 150 of FIG. 1 configured to receive test inputs 802 and to generate output 804 in response to those inputs. Test inputs 802 may be generated by a testing apparatus, and may include, for example and without limitation, a swept sine wave, a chirp, a step function, and potentially other types of signals used to measure the dynamic response of a physical system.

A sensor array 806 is coupled to loudspeaker 150 and configured to measure various time-varying physical quantities 808 associated with loudspeaker 150 when loudspeaker 150 responds to test inputs 802. Those quantities include output pressure P of loudspeaker, displacement D of a voice coil associated with loudspeaker 150, and voice coil current I that drives loudspeaker 150 in response to test signals 802. An adaptive algorithm 810 is configured to receive physical attributes 808, as well as output 804, and to then generate lumped parameters model 812.

Lumped parameters model 812 is a physical model of loudspeaker 150 that includes loudspeaker parameters 132. Lumped parameter model 812 may be defined by a set of differential equations that, in conjunction with the numerical values of loudspeaker parameters 132, define the dynamic response of loudspeaker 150. Adaptive algorithm 810 may employ a gradient descent algorithm in order to estimate values for loudspeaker parameters 132. Based on these loudspeaker parameters 132, the above-mentioned differential equations may then be evaluated. The differential equations and loudspeaker parameters 132 are set forth below in conjunction with Equations 1-4 and Table 1.

Given the input (voltage) stimulus u(t), the voice coil current I(t) can be calculated using Equation 1:

$$u(t) = iR_{vc} + \frac{d(iL_e(x, i))}{dt} + \frac{d(i_2 L_2(x, i))}{dt} + Bl(x)v \qquad \text{Equation 1}$$

The displacement x(t) can be computed using Equation 2:

$$Bl(x)i = vR_{ms} + K_{tot}(x)x + M_{tot}\frac{dv}{dt} + F_m(x, i, i_2) \qquad \text{Equation 2}$$

The reluctance force is calculated using Equation 3:

$$F_m(x, i, i_2) = -\frac{i^2}{2}\frac{\partial(L_e(x, i))}{\partial x} - \frac{i_2^2}{2}\frac{\partial(L_2(x, i))}{\partial x} \qquad \text{Equation 3}$$

The output pressure p(t) can be calculated using Equation 4:

$$p(t) = \frac{\rho S_d}{2\pi x_{mic}} \frac{d^2(x(t))}{dt^2} \quad \text{Equation 4}$$

The output of the lumped parameter model is p(t), which defines pressure as a function of time based on loudspeaker parameters 132. These loudspeaker parameters, some of which are referenced above in Equations 1-4, are tabulated below in conjunction with Table 1:

Force Factor Bl(x) Coefficient
Stiffness $K_{ms}(x)$ Coefficient
Voice Coil Inductance $L_e(x)$ Polynomial
Cone Surface Area $S_d$
Mechanical Resistance $R_{ms}$
Voice Coil DC Resistance $R_e$
Total Moving Mass ($M_{ms}$)
Parasitic inductance $L_2$ (x)
Parasitic resistance $R_2(x)$
Flux Modulation $L_e(i)$
Density of Air ρ
Loudspeaker cone to microphone distance $x_{mic}$ Table 1

Based on lumped parameters model 812 and loudspeaker parameters 132, a model inverse function 814 may compute an inverse transfer function 816 for loudspeaker 150. This inverse transfer function may provide the response curve for corrector 130 in embodiments where that corrector is generated via signal chain 800. Tuning filter 120 may be generated via a similar approach, as described in conjunction with FIG. 8B.

As shown in FIG. 8B, a signal chain 820 includes a loudspeaker 850 configured to receive test inputs 822 and to generate output 824 in response to those inputs. Test inputs 822 may be generated by a testing apparatus, and may include, for example and without limitation, a swept sine wave, a chirp, a step function, and potentially other types of signals used to measure the dynamic response of a physical system.

A sensor array 826 is coupled to loudspeaker 850 and configured to measure various time-varying physical quantities 828 associated with loudspeaker 850 when loudspeaker 850 responds to test inputs 822. Those quantities include output pressure P of loudspeaker 850, displacement D of a voice coil associated with loudspeaker 850, and voice coil current I that drives loudspeaker 850 in response to test signals 822. An adaptive algorithm 830 is configured to receive physical attributes 828, well as output 824, and to then generate lumped parameters model 832.

Lumped parameters model 832 is a physical model of loudspeaker 850 that includes tuning parameters 122 associated with loudspeaker 850. Lumped parameter model 832 may be defined by a set of differential equations that, in conjunction with the numerical values of tuning parameters 122, define the dynamic response of loudspeaker 850. Adaptive algorithm 830 may employ a gradient descent algorithm in order to estimate values for tuning parameters 122. The above-mentioned differential equations may then be evaluated using those tuning parameters. The differential equations and tuning parameters 122 may be substantially similar to those set forth in Equations 1-4 and Table 1.

Referring generally to FIGS. 8A-8B, signal chains 800 and 820 are similar in that both chains can be used to model a physical system and associated parameters. Signal chain 800, in contrast to signal chain 820, though, specifically determines the inverse transfer function of a physical system so that response characteristics of that physical system can be mitigated. Signal chain 820, conversely, determines a system model so that response characteristics of that system can be reproduced. In practice, both of signal chains 800 and 820 may be implemented, as a whole or in part, by emulation application 218 shown in FIG. 2.

As mentioned, any technically feasible approach to modeling physical systems can be implemented in order to generate tuning filter 120, corrector 130, and corresponding parameters. A generic, stepwise approach is described in greater detail below in conjunction with FIG. 9.

Figure 9:
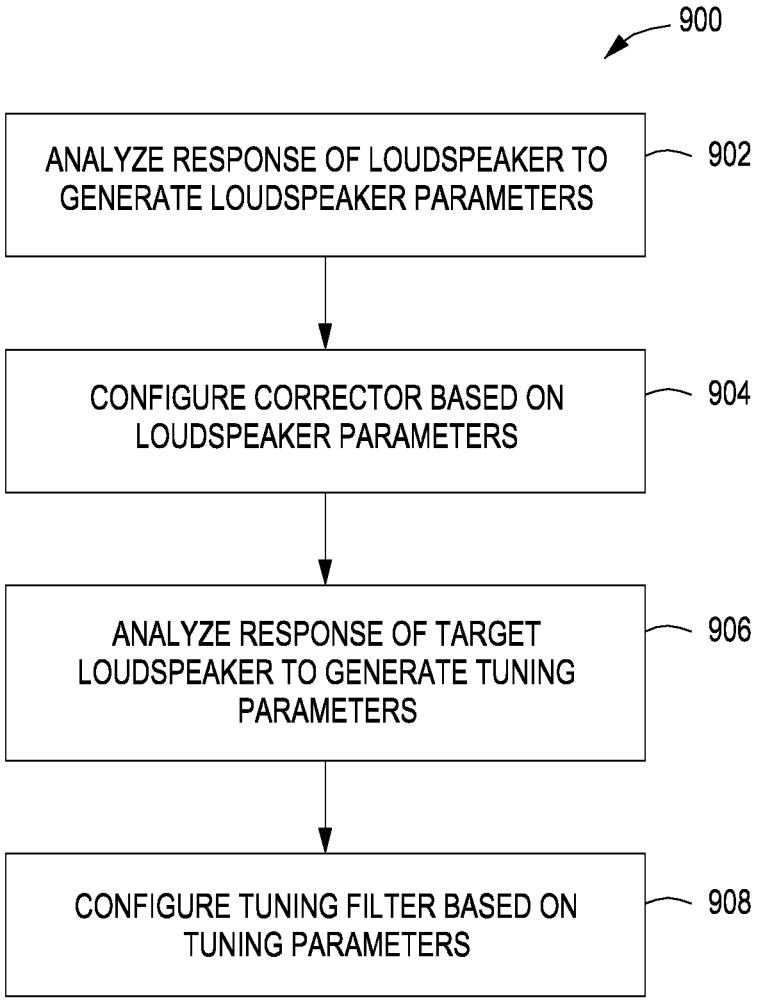
FIG. 9 is a flow diagram of method steps configuring a tuning filter and a corrector to modify a distortion response of a loudspeaker, according to various embodiments.

FIG. 9 is a flow diagram of method steps configuring a tuning filter and a corrector to modify a distortion response of a loudspeaker, according to various embodiments. Although the method steps are described in conjunction with the systems of FIGS. 1-8B, persons skilled in the art will understand that any system configured to perform the method steps, in any order, is within the scope of the disclosed embodiments.

As shown, a method 900 begins at step 902, emulation application 218 of FIG. 2 analyzes the response of loudspeaker 150 to generate loudspeaker parameters 132. In one embodiment, emulation application 218 implements adaptive algorithm 810 to compute lumped parameters model 812, which incorporate those parameters, as discussed above in conjunction with FIG. 8A.

At step 904, emulation application 218 configures corrector 130 based on loudspeaker parameters 132 generated at step 902. In doing so, emulation application may compute an inverse of a lumped parameter model of loudspeaker 150, in like fashion as described above in conjunction with FIG. 8A.

At step 906, emulation application 218 analyzes the response of loudspeaker 850 to generate tuning parameters 122. In one embodiment, emulation application 218 implements adaptive algorithm 822 to compute lumped parameters model 832, which incorporate those parameters, as discussed above in conjunction with FIG. 8B.

At step 908, emulation application 218 configures the tuning filter 120 based on tuning parameters 122 generated at step 906. In doing so, emulation application 218 may rely on a gradient descent algorithm to estimate tuning parameters 122, as described above in conjunction with FIG. 8B.

By implementing the generic approach set forth above in conjunction with FIG. 9, or the more specific approaches discussed above in conjunction with FIGS. 8A-8B, various models can be generated and used to mitigate unwanted distortion generated by loudspeaker 150 and incorporate desired distortion associated with another loudspeaker.

In sum, a corrector is configured to transform audio signals to compensate for unwanted distortion characteristics of a loudspeaker. A tuning filter is configured to transform audio signals to incorporate desired distortion characteristics associated with a target loudspeaker. By chaining together the tuning filter and the corrector, an audio signal can be modified so that the loudspeaker, when outputting the audio signal, has response characteristics of the target loudspeaker.

At least one advantage of the disclosed techniques is that unwanted distortion characteristics associated with the loudspeaker can be mitigated, while desired distortion characteristics associated with the other loudspeaker can be incorporated into the audio signal. Accordingly, the loudspeaker can be configured to emulate the sound of the target loudspeaker. More generally, without changing the physical construction of the loudspeaker, the response of the loudspeaker can be tuned to have any desired response.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable processors.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While the preceding is directed to embodiments of the present disclosure, other and further embodiments of the disclosure may be devised without departing from the basic scope thereof, and the scope thereof is determined by the claims that follow.

What is claimed is:

1. A computer-implemented method for generating a desired response for a loudspeaker, the method comprising:

tuning an audio signal based on a model of a first output device to emulate one or more desired distortion characteristics associated with the first output device to produce a tuned audio signal;

correcting the tuned audio signal to attenuate one or more undesired distortion characteristics associated with a second output device to produce a corrected audio signal;

outputting a final signal, via the second output device, that is based on the corrected audio signal, wherein the final signal includes the one or more desired distortion characteristics associated with the first output device.

2. The computer-implemented method of claim 1, wherein the final signal includes less or none of the one or more undesired distortion characteristics associated with the second output device.

3. The computer-implemented method of claim 1, wherein tuning the audio signal comprises modifying the audio signal based on a first transfer function associated with the first output device.

4. The computer-implemented method of claim 3, wherein the first transfer function indicates both linear and non-linear response characteristics associated with the first output device.

5. The computer-implemented method of claim 3, further comprising generating the model of the first output device to determine the first transfer function, wherein the model comprises a physical system model, a Hammerstein model, a Volterra kernel, or a lumped parameters model.

6. The computer-implemented method of claim 1, wherein correcting the tuned audio signal comprises modifying the tuned audio signal based on a second transfer function associated with the second output device.

7. The computer-implemented method of claim 6, wherein the second transfer function indicates both linear and non-linear response characteristics associated with the second output device.

8. The computer-implemented method of claim 6, further comprising generating a model of the second output device to determine the second transfer function, wherein the model comprises a physical system model, a Hammerstein model, a Volterra kernel, or a lumped parameters model.

9. A non-transitory computer-readable medium that, when executed by a processor, configures the processor to generate a desired response for a loudspeaker, by performing the steps of:

tuning an audio signal based on a model of a first output device to emulate one or more desired distortion characteristics associated with the first output device to produce a tuned audio signal;

correcting the tuned audio signal to attenuate one or more undesired distortion characteristics associated with a second output device to produce a corrected audio signal;

outputting a final signal, via the second output device, that is based on the corrected audio signal, wherein the final signal includes the one or more desired distortion characteristics associated with the first output device.

10. The non-transitory computer-readable medium of claim 9, wherein the final signal includes less or none of the one or more undesired distortion characteristics associated with the second output device.

11. The non-transitory computer-readable medium of claim 9, wherein tuning the audio signal comprises modifying the audio signal based on a first nonlinear transfer function associated with the first output device.

12. The non-transitory computer-readable medium of claim 11, further comprising estimating a first set of parameters via a gradient descent algorithm to determine the first transfer function, wherein the first set of parameters governs dynamics of the first output device.

13. The non-transitory computer-readable medium of claim 9, wherein correcting the tuned audio signal comprises modifying the tuned audio signal based on a second nonlinear transfer function associated with the second output device.

14. The non-transitory computer-readable medium of claim 13, further comprising estimating a second set of parameters via a gradient descent algorithm to determine the second transfer function, wherein the second set of parameters governs dynamics of the second output device.

15. A system configured to generate a desired response for a loudspeaker, comprising:

a memory storing an emulation application; and a processor coupled to the memory that, when executing the emulation application, is configured to:

tune an audio signal based on a model of a first output device to emulate one or more desired distortion characteristics associated with the first output device to produce a tuned audio signal, correct the tuned audio signal to attenuate one or more undesired distortion characteristics associated with a second output device to produce a corrected audio signal, output a final signal, via the second output device, that is based on the corrected audio signal, wherein the final signal includes the one or more desired distortion characteristics associated with the first output device.

16. The system of claim 15, wherein the final signal includes less or none of the one or more undesired distortion characteristics associated with the second output device.

17. The system of claim 15, wherein the processor is configured to tune the audio signal by modifying the audio signal based on a first nonlinear transfer function associated with the first output device.

18. The system of claim 15, wherein the processor is configured to correct the tuned audio signal by modifying the tuned audio signal based on a second nonlinear transfer function associated with the second output device.

19. The system of claim 18, wherein the processor modifies the tuned audio signal by applying an inverse of the second transfer function to the tuned audio signal.

20. The system of claim 15, wherein the first output device comprises a first amplifier for amplifying musical instruments and the second output device comprises a second amplifier for amplifying a musical instrument configured to generate the audio signal.

* * * * *